United States Patent [19]

Montiel

[11] 4,446,965

[45] May 8, 1984

[54] APPLICATOR FOR LIQUIDS

[76] Inventor: Alexandra Montiel, 639 Bushwick Ave., Brooklyn, N.Y. 11206

[21] Appl. No.: 419,056

[22] Filed: Sep. 16, 1982

Related U.S. Application Data

[62] Division of Ser. No. 301,457, Sep. 14, 1981.

[51] Int. Cl.[3] ..... B65D 81/24

[52] U.S. Cl. ..... 206/205; 206/581; 206/229; 206/438; 206/823

[58] Field of Search ..... 206/438, 361, 823, 229, 206/205, 581

[56] References Cited

U.S. PATENT DOCUMENTS 2,469,763 5/1949 Conwell ..... 206/229

2,803,252 8/1957 Bloome ..... 206/438

*Primary Examiner*—Joseph Man-Fu Moy

*Attorney, Agent, or Firm*—Nathaniel Altman

[57] ABSTRACT

An applicator for liquids, especially finger nail treating liquids, comprises a reclosable container substantially filled with a synthetic foam sponge saturated with the liquid contents. The sponge may be slit to accept the insertion of at least one finger tip at a time for application of the treating liquid.

4 Claims, 5 Drawing Figures

APPLICATOR FOR LIQUIDS

BACKGROUND OF THE INVENTION

This is a divisional application deriving from copending parent application U.S. Ser. No. 06/301,457, filed Sept. 14, 1981 and titled "Combination Finger Nail Polish-Remover Conditioner-Primer in Applicator Package".

The primary object of this invention is to provide a novel spill-proof applicator for liquids, especially liquids for treating finger nails such as polish-removers, nail and cuticle conditioners and priming coats.

SUMMARY OF THE INVENTION

The spill-proof applicator of this invention in a preferred form is a closed container substantially filled with a synthetic foam sponge which is saturated with the treating liquid contained therein. The sponge may have a centrally disposed cross-slit to permit easy introduction of a finger tip for treatment when the container cover is removed. In another embodiment, the container is large enough for the sponge to have a circumferential slit near its periphery to accept all five finger nails of one hand for simultaneous treatment.

The best mode for practising the present invention now contemplated will be described in full detail in connection with the accompanying drawings, wherein:

DRAWINGS

DESCRIPTION OF THE PREFERRED EMBODIMENTS

Figure 1:
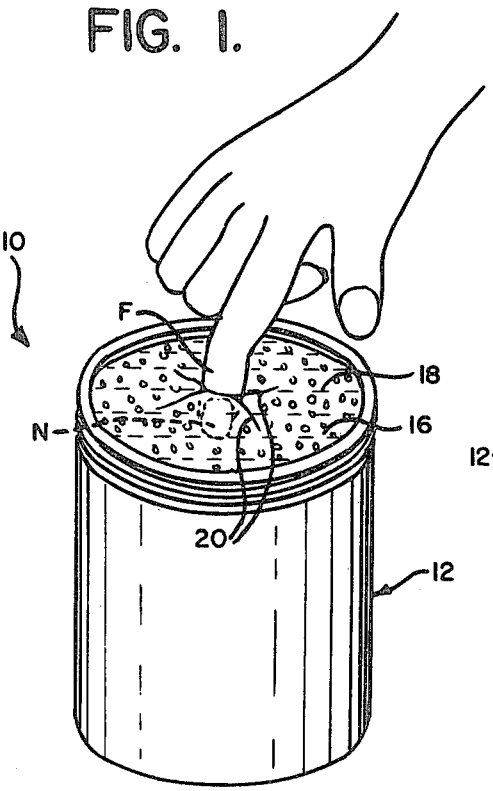
FIG. 1 is a perspective view showing a preferred form of the applicator of this invention in use.
Figure 2:
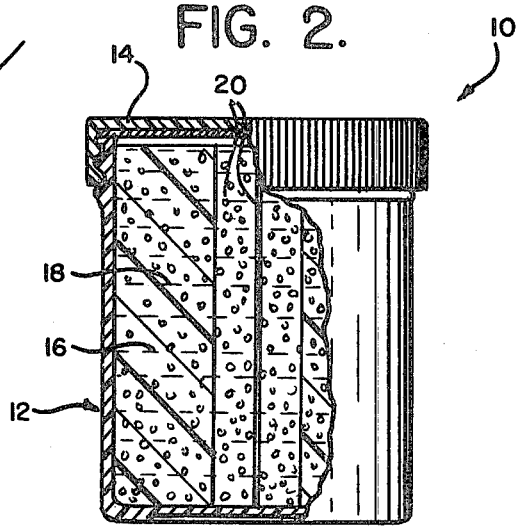
FIG. 2 is an elevational view, partially broken away, of the closed applicator of FIG. 1.
Figure 3:
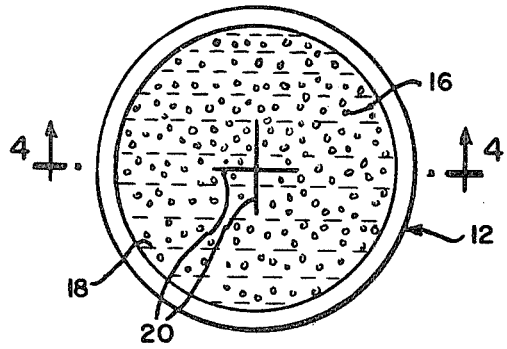
FIG. 3 is a top plan view of the applicator of FIG. 2 with its cover removed.
Figure 4:
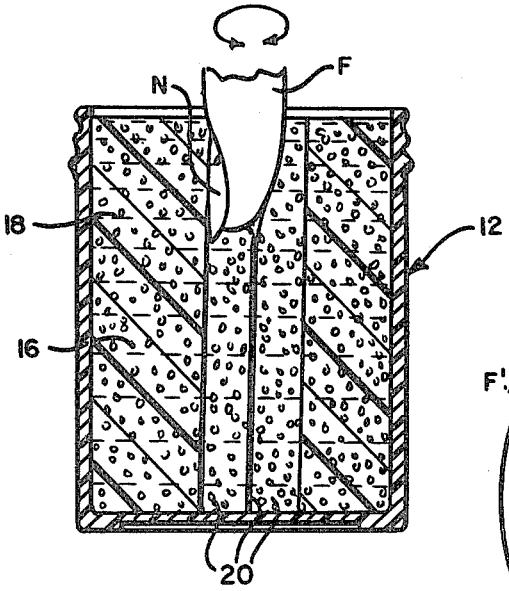
FIG. 4 is a sectional view taken along line 4—4 of FIG. 3, with a finger inserted for nail treatment.

FIGS. 1–4 illustrate one preferred form of the finger nail treating liquid applicator, generally designated 10, with container 12 and tightly fitting screw cap cover 14 (FIG. 2). Container 12, here shown as a cylindrical plastic jar, obviously may be made of other suitable materials and formed in any convenient shape.

Synthetic plastic foam sponge 16, saturated with treating liquid 18 as shown, is dimensioned substantially to fill, and to be held upslippably within, container 12. As a result of the fit of sponge 16 in container 12 and the consistency of saturating liquid 18, opened container 12 may be upset inadvertently or even deliberately inverted without dislodging sponge 16 or spilling any liquid 18. Sponge 16 is provided with centrally disposed cross-slits 20 to facilitate insertion of a finger tip F to be treated and to insure good contact between the finger nail N and a surface of sponge 16. While any synthetic plastic foam sponge not affected by the solvents in treating liquid 18 may be used, the preferred sponge 16 is a fine-grained hybrid polyurethane with a density of 2.2 pounds per cubic foot.

To use product 10, each finger tip F in turn is inserted into slits 20, held for a few seconds, then rotated slightly. In the case where liquid 18 is nail polish remover, gentle friction against sponge 16, constantly wet by its own wicking action, loosens the old nail polish, permitting liquid 18 to dissolve it (coloring pigments in the old nail polish settle down through sponge 18 to the bottom of container 12 and do not interfere with subsequent nail treatments).

Figure 5:
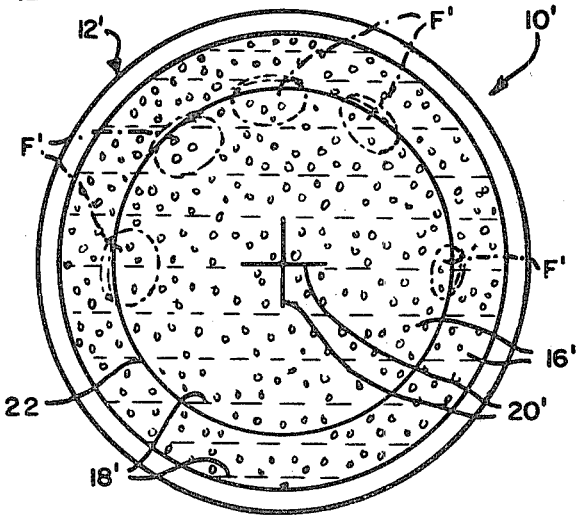
FIG. 5 is a top plan view of a second embodiment of this invention, the package being shown with its cover removed.

FIG. 5 illustrates another embodiment of the invention, wherein applicator 10' has a container 12', sponge 16', treating liquid 18' and centrally disposed cross-slit 20'. In addition, a circumferential slit 22 is provided near the periphery of sponge 16' to permit the simultaneous insertion and treatment of all five fingertips F' of one hand.

Full details and the concepts of this invention have been disclosed; its scope is defined by the ensuing claims.

I claim:

1. Applicator means for containing and applying a fingertip-treating liquid composition, which comprises:

a reclosable container; and porous resilient absorbent means, shaped and dimensioned to fit unslippably within, and substantially to fill, said reclosable container, said absorbent means being a synthetic plastic foam sponge saturated with said liquid composition, said synthetic plastic foam sponge having at least one centrally disposed slit extending vertically into said sponge for facilitating entry of, and wet-sponge-contact with, a fingertip to be treated, said sponge also having a vertically extending slit positioned inwardly of, but following the periphery of, said sponge; said container and said sponge being dimensioned so that, when said container is open, all five fingertips of one hand may be inserted simultaneously into said peripheral vertically extending slit for treatment.

2. Applicator means for liquids in accordance with claim 1, wherein said synthetic plastic foam sponge is made of hybrid polyurethane and has a density in the range between 1.5 and 3 pounds per cubic foot.

3. Applicator means for liquids in accordance with claim 1, wherein said synthetic plastic foam sponge has a pair of centrally disposed slits at right angles to one another, said slits extending vertically through said sponge.

4. Applicator means for liquids in accordance with claim 1, wherein said sponge, saturated with the liquid contained therein, is dimensioned to fit within said reclosable container so that said container, when opened, may be inverted without said sponge falling out and without the liquid spilling.

* * * * *